US009442443B2

(12) United States Patent
Tsuchihashi et al.

(10) Patent No.: US 9,442,443 B2
(45) Date of Patent: Sep. 13, 2016

(54) ROLLER HAVING CORE WITH AN ELASTIC LAYER INCLUDING TAPERED PORTION AND FIXING APPARATUS WITH SUCH ROLLER

(71) Applicant: CANON KABUSHIKI KAISHA, Tokyo (JP)

(72) Inventors: Naoto Tsuchihashi, Yokohama (JP); Toshiaki Miyashiro, Suntou-gun (JP); Eiji Uekawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/882,731

(22) Filed: Oct. 14, 2015

(65) Prior Publication Data

US 2016/0109836 A1 Apr. 21, 2016

(30) Foreign Application Priority Data

Oct. 21, 2014 (JP) ..... 2014-214833

(51) Int. Cl.
*G03G 15/20* (2006.01)

(52) U.S. Cl.
CPC ..... *G03G 15/2057* (2013.01)

(58) Field of Classification Search
CPC ..... G03G 15/2057; G03G 15/206
USPC ..... 399/333
See application file for complete search history.

(56) References Cited

U.S. PATENT DOCUMENTS 4,789,565 A * 12/1988 Kon ..... G03G 15/2057 427/375
5,253,026 A * 10/1993 Tamary ..... G03G 15/2053 399/333
5,355,204 A * 10/1994 Aoki ..... G03G 15/206 399/329
5,689,788 A * 11/1997 Moser ..... G03G 15/206 399/328
6,944,419 B2 * 9/2005 Kawamoto ..... G03G 15/2025 399/333
7,203,438 B2 4/2007 Omata et al.
7,215,899 B2 5/2007 Kimizuka et al.
7,251,447 B2 7/2007 Kanamori et al.
7,343,131 B2 * 3/2008 Nakajima ..... G03G 15/206 399/333
7,518,089 B2 4/2009 Hashiguchi et al.

(Continued)

FOREIGN PATENT DOCUMENTS

JP 61-4925 2/1986
JP 11-24479 A 1/1999

(Continued)

OTHER PUBLICATIONS

U.S. Appl. No. 14/808,428, filed Jul. 24, 2015.

(Continued)

*Primary Examiner* — Susan Lee
(74) *Attorney, Agent, or Firm* — Fitzpatrick, Cella, Harper & Scinto

(57) ABSTRACT

A roller used for a fixing apparatus has: a core; a first elastic layer that is formed outside the core and includes a first tapered portion on an edge of the roller in an axis direction; and a second elastic layer that is formed outside the first elastic layer and includes a second tapered portion on the edge in the axis direction on the same side as the first elastic layer. The second elastic layer has a hardness that is higher than the hardness of the first elastic layer. A second start point, which is a start point of the second tapered portion, is set in a position closer to the center of the roller in the axis direction than a first start point, which is a start point of the first tapered portion.

14 Claims, 7 Drawing Sheets

(56) References Cited

U.S. PATENT DOCUMENTS

| | | | | |
|---|---|---|---|---|
| 7,734,240 | B2 * | 6/2010 | McNamee | G03G 15/2053 399/333 |
| 7,974,563 | B2 * | 7/2011 | Sakai | G03G 15/2053 399/333 |
| 8,086,160 | B2 * | 12/2011 | Nishizawa | G03G 15/2057 399/333 |
| 8,606,164 | B2 | 12/2013 | Uekawa et al. | |
| 8,626,046 | B2 | 1/2014 | Sekihara et al. | |
| 8,886,098 | B2 * | 11/2014 | Fromm | G03G 15/2053 399/333 |
| 8,977,178 | B2 * | 3/2015 | Suzuki | G03G 15/206 399/329 |
| 9,002,249 | B2 | 4/2015 | Uekawa et al. | |
| 2002/0031382 | A1 * | 3/2002 | Yura | G03G 15/2053 399/333 |
| 2009/0116886 | A1 | 5/2009 | Sakai et al. | |
| 2011/0217092 | A1 | 9/2011 | Sekihara et al. | |
| 2012/0063821 | A1 | 3/2012 | Murakami et al. | |
| 2014/0205335 | A1 | 7/2014 | Kimura | |
| 2015/0132020 | A1 | 5/2015 | Saito et al. | |

FOREIGN PATENT DOCUMENTS

| | | | |
|---|---|---|---|
| JP | 2007328101 | A * | 12/2007 |
| JP | 2009-031772 | A | 2/2009 |
| JP | 2010-151960 | A | 7/2010 |
| JP | 2010-217297 | A | 9/2010 |

OTHER PUBLICATIONS

"Properties Bulletin DuPont PFA" XP55281372, dated Dec. 1, 1996.

Extended European Search Report dated Jun. 28, 2016, in Application No. 15187049.0.

* cited by examiner

ROLLER HAVING CORE WITH AN ELASTIC LAYER INCLUDING TAPERED PORTION AND FIXING APPARATUS WITH SUCH ROLLER

BACKGROUND OF THE INVENTION

1. Field of the Invention

The present invention relates to a roller and a fixing apparatus including the roller.

2. Description of the Related Art

As a fixing apparatus that is included in an electrophotographic printer or copier, a film heating type fixing apparatus is known, which is constituted by a plate heater, a fixing film that moves with contacting the heater, and a pressure roller with which the heater forms a nip portion via the fixing film.

In the film heating type fixing apparatus, if small-sized recording materials are continuously printed, a temperature rise in a non-paper pressing region, that is, an excessive rise of temperature in a region where film or recording material of the pressure roller does not pass (non-paper passing region), is easily generated. If the state of the excessive temperature rise in the non-paper passing region continues, the pressure roller or the like tends to be damaged.

Therefore, in Japanese Patent Application Laid-open No. 2009-31772, a pressure roller, having an elastic layer constituted by two elastic layers whose thermal conductivity values are concentrically different around the core of the roller, is disclosed as a means of decreasing the above-mentioned temperature rise in the non-paper passing region. In this pressure roller, the thermal conductivity of the pressure roller in the longitudinal direction is increased by dispersing thermo-conductive filler, which is oriented in the longitudinal direction, in the surface side elastic layer, whereby the temperature unevenness of the pressure roller in the longitudinal direction is decreased. Furthermore, the thermal conductivity of the lower side elastic layer is set to be lower than the thermal conductivity of the surface side elastic layer, whereby the outflow of heat to the core is controlled.

However, in some types of pressure rollers having two elastic layers like this, a tapered portion is created at the edge of the elastic layers. If such a pressure roller is installed in the film heating type fixing apparatus and continuous printing is performed, it is observed that a portion of the surface of the fixing film, where an area around the tapered portion of the pressure roller contacts, is subject to abrasion more so than the surface where an untapered area contacts. The abrasion generated on the surface of the fixing film is hereafter called "surface layer abrasion".

FIG. 7A shows a result of measuring the change of hardness of the pressure roller in the longitudinal direction using a micro-hardness meter when the pressure roller is in contact with a region where surface layer abrasion is generated on the fixing film. As shown in FIG. 7A, an abnormal hardness region HA, where the hardness of the pressure roller in the region near the tapered portion abnormally increases as the tapered portion is approached, was observed. FIG. 7B shows a result of measuring the pressure distribution in a nip portion N of a fixing apparatus using this pressure roller, using a pressure sensitive paper. According to FIG. 7B, the pressure of the nip portion N partially increases in the portion of the abnormal hardness region HA.

If an area where the hardness of the elastic layer is high is generated in an area near the tapered portion, created at the edge of the elastic layer of the pressure roller, the surface layer abrasion worsens, which is a problem.

SUMMARY OF THE INVENTION

An object of the present invention is to provide a roller used for a fixing apparatus, comprising: a core; a first elastic layer that is formed outside the core and includes a first tapered portion on an edge of the roller in an axis direction; and a second elastic layer that is formed outside the first elastic layer and includes a second tapered portion on the edge in the axis direction on the same side as the first elastic layer. The second elastic layer has a hardness that is higher than the hardness of the first elastic layer. A second start point, which is a start point of the second tapered portion, is set in a position closer to the center of the roller in the axis direction than a first start point which is a start point of the first tapered portion.

Another object of the present invention is to provide a roller used for a fixing apparatus, comprising: a core; and an elastic layer that is formed outside the core, the elastic layer including a first elastic layer and a second elastic layer formed outside the first elastic layer and having a hardness that is higher than the hardness of the first elastic layer. A tapered portion is formed on an edge of the elastic layer in an axis direction, and the tapered portion has a region where the ratio of the thickness of the second elastic layer to the thickness of the first elastic layer decreases gradually as a position approaches an edge of the roller in the axis direction on the side where the tapered portion is formed.

Another object of the present invention is to provide a roller used for a fixing apparatus, comprising: a core; a first elastic layer that is formed outside the core and includes a first tapered portion on an edge of the roller in an axis direction; and a second elastic layer that is formed outside the first elastic layer and includes a second tapered portion on the edge in the axis direction on the same side as the first elastic layer. The second elastic layer has a hardness that is higher than the hardness of the first elastic layer. A first start point, which is a start point of the first tapered portion, is set in a position closer to the center of the roller in the axis direction than a second start point, which is a start point of the second tapered portion.

Another object of the present invention is to provide a roller used for a fixing apparatus, comprising: a core; and an elastic layer that is formed outside the core, the elastic layer including a first elastic layer and a second elastic layer formed outside the first elastic layer and having a hardness that is higher than the hardness of the first elastic layer. A tapered portion is formed on an edge of the elastic layer in the axis direction. The tapered portion has a region where the ratio of the thickness of the second elastic layer to the thickness of the first elastic layer increases gradually as a position approaches the edge of the roller in the axis direction on the side where the tapered portion is formed.

Another object of the present invention is to provide a fixing apparatus that conveys and heats a recording material bearing a toner image at a nip portion, comprising: a heating rotating member; and a roller that contacts the heating rotating member and forms the nip portion. The roller includes a core, a first elastic layer that is formed outside the core, and a second elastic layer formed outside the first elastic layer and having a hardness that is higher than the hardness of the first elastic layer. A first tapered portion is formed on an edge of the first elastic layer in an axis direction of the roller, and a second tapered portion is formed on an edge of the second elastic layer in the axis direction. A second start point, which is a start point of the second tapered portion, is set in a position closer to the center of the roller in the axis than a first start point which is a start point of the first tapered portion.

Another object of the present invention is to provide a fixing apparatus that conveys and heats a recording material bearing a toner image at a nip portion, comprising: a heating rotating member; and a roller that contacts the heating rotating member and forms the nip portion. The roller includes a core, a first elastic layer that is formed outside the core, and a second elastic layer formed outside the first elastic layer and having a hardness that is higher than the hardness of the first elastic layer. A first tapered portion is formed on an edge of the first elastic layer in the axis direction of the roller, and a second tapered portion is formed on an edge of the second elastic layer in the axis direction. A first start point, which is a start point of the first tapered portion, is set in a position closer to the center of the roller than a second start point, which is a start point of the second tapered portion.

Further features of the present invention will become apparent from the following description of exemplary embodiments with reference to the attached drawings.

DESCRIPTION OF THE EMBODIMENTS

Hereinafter, embodiments of the present invention will be described in detail based on practical examples with reference to the drawings. Dimensions, materials, shapes, relative positions or the like of components described in the embodiments should be appropriately changed according to the configuration and various conditions of the apparatus to which the invention is applied. In other words, the scope of the present invention is not limited to the following embodiments.

PRACTICAL EXAMPLE

Figure 1:
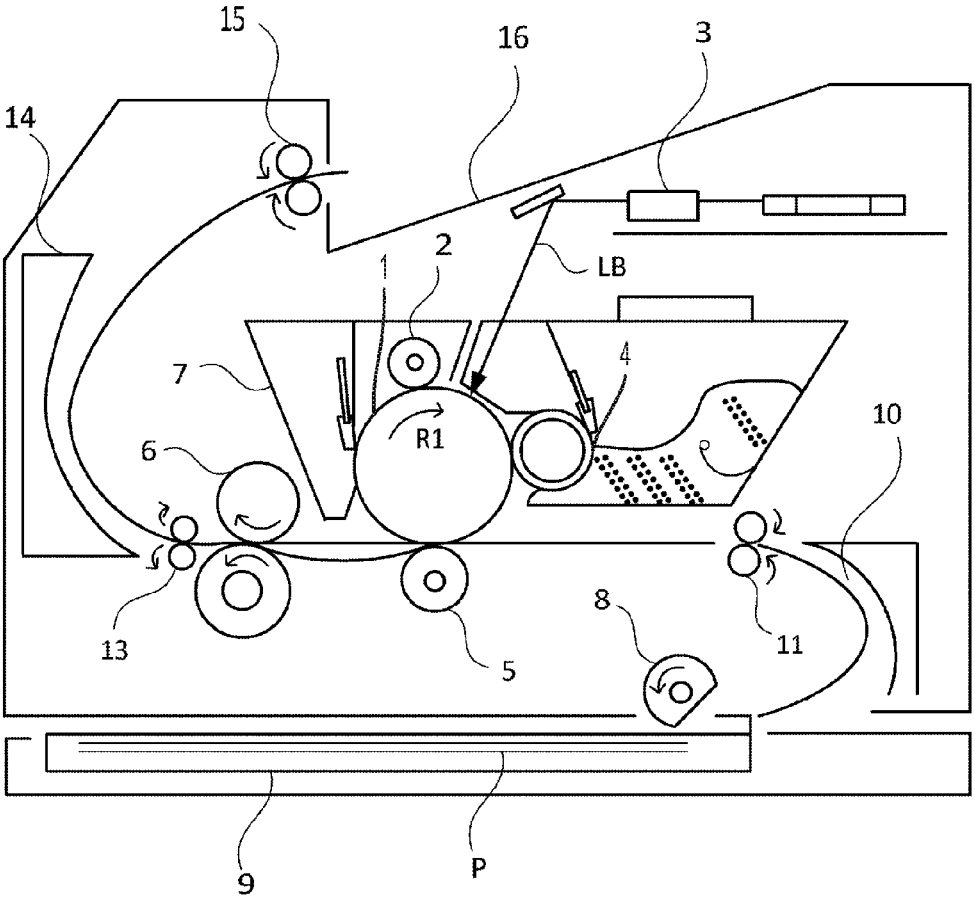
FIG. 1 is a schematic cross-sectional view depicting a configuration of an image forming apparatus according to the present embodiment.

An overview of the configuration of an electro-photographic type laser beam printer will be described with reference to FIG. 1, as an example of an image forming apparatus according to the present practical example. FIG. 1 is a schematic cross-sectional view depicting the configuration of the image forming apparatus according to the present embodiment.

The image forming apparatus according to the present embodiment has an electro-photographic photoreceptor (hereafter called "photosensitive drum") 1 as a rotating drum type image bearing member. The photosensitive drum 1 is constituted by a photosensitive material layer of OPC, amorphous Se, amorphous Si or the like formed on an outer peripheral surface of a cylinder (drum) type conductive substrate made of aluminum, nickel or the like.

The photosensitive drum 1 is drum driven in the arrow R1 direction (clockwise) in FIG. 1 at a predetermined peripheral velocity (process speed), and during this rotation process, the outer peripheral surface (surface) of the photosensitive drum 1 is uniformly charged to a predetermined polarity and potential by a charging roller 2, which is a charging unit. The uniformly charged surface on the photosensitive drum 1 is scanned and exposed by a laser beam LB, which is outputted from a laser beam scanner 3 and which is modulation-controlled (ON/OFF controlled) according to the image information. As a result, an electrostatic latent image is formed on the surface of the photosensitive drum 1 according to the target image information.

The latent image formed on the surface of the photosensitive drum 1 is developed by the toner T supplied by a developing device 4 (developing unit). The developed latent image is visualized and a toner image (developer image) is formed on the surface of the photosensitive drum 1. For the developing method, a jumping developing method, a two-component developing method, a FEED developing method or the like is used, and the developing method is often used with a combination of image exposure and reversal development.

On the other hand, recording materials P, which are loaded and stored in a feeding cassette 9, are fed one at a time by the driving of a feeding roller 8 to a resist roller 11 by way of a sheet path, which includes a guide 10 and the resist roller 11. The resist roller 11 feeds recording materials P to a transfer nip portion between the surface of the photosensitive drum 1 and the outer peripheral surface (surface) of the transfer roller 5 at a predetermined control timing. Recording materials P are held and conveyed by the transfer nip portion T, and during this conveying process, the toner image on the surface of the photosensitive drum 1 is sequentially transferred onto the recording materials by the transfer bias applied to the transfer roller 5. As a result, each recording material P bears an unfixed toner image.

Each recording material P bearing the unfixed toner image is sequentially separated from the surface of the photosensitive drum 1, and is discharged from the transfer nip portion, and enters a nip portion N of the fixing apparatus 6 via a conveyance guide. The recording material P receives heat and pressure by the nip portion N of the fixing apparatus 6, whereby the toner image is heated and fixed to the surface of the recording material P. The recording material P that exited from the fixing apparatus 6 is discharged to a discharge tray 16 via a sheet path, which includes a conveyance roller 13, a guide 14 and a discharge roller 15.

The surface of the photosensitive drum 1, after the recording material P is separated, is cleaned by a cleaning apparatus 7 (cleaning unit) which removes adhering contaminants, such as untransferred toner, and is then repeatedly used for forming images. The image forming apparatus of the present embodiment is an A3 sized paper-supported printer, and the print speed thereof is 50 ppm (A4, landscape). The toner has styrene-acrylic resin as a base material, to which a charge control agent, a magnetic body, silica or the like, are internally or externally added as required, and has a glass transition point of 55to 65° C.

Figure 2:
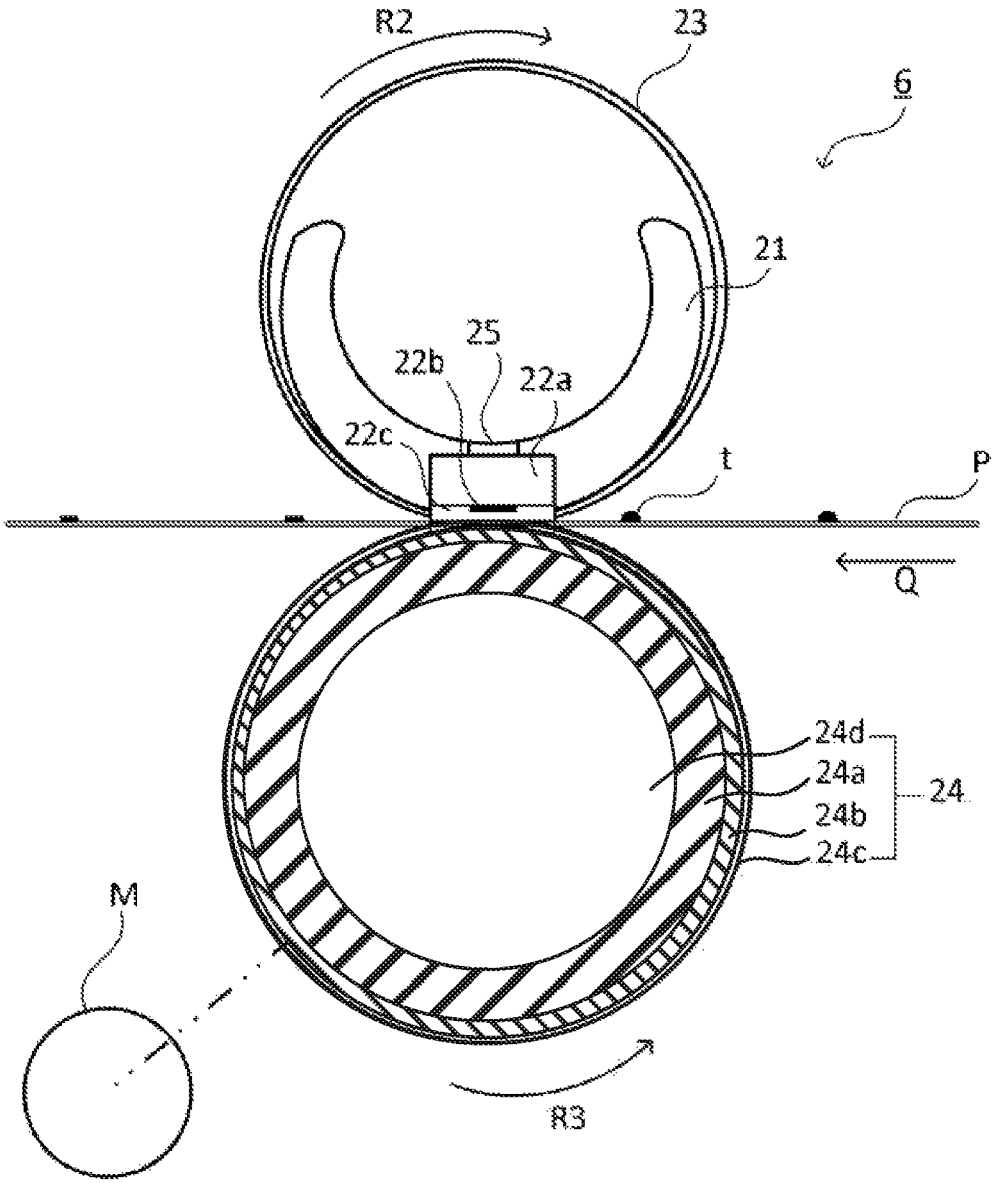
FIG. 2 is a schematic cross-sectional view depicting a configuration of a fixing apparatus of the present embodiment.

Next, details on the configuration of the fixing apparatus of the image forming apparatus according to the present embodiment will be described with reference to FIG. 2. FIG. 2 is a schematic cross-sectional view depicting the configuration of the fixing apparatus of the present embodiment. In the following description, the longitudinal direction refers to a rotation axis direction of the pressure roller 24 and a direction perpendicular to the recording material conveying direction Q.

The fixing apparatus 6 of the present embodiment is a film heating type fixing apparatus. As shown in FIG. 2, the fixing apparatus 6 includes a film guide member 21, a heater 22 (heating body), a film 23 (heating member) and a pressure roller 24 (pressure member).

A film guide member (stay) 21 is a gutter-shaped member, which is formed in the longitudinal direction, and has a semicircular cross-sectional shape. The heater 22 is held in a groove, which is formed approximately at the center of the bottom face of the film guide member 21 along the longitudinal direction. The film 23 is an endless belt type (cylindrical) heat resistant film, which is flexible and loosely inserted into the film guide member 21. The driving force of a driving source M is transferred to the pressure roller 24 via such a power transfer mechanism as a gear (not illustrated), and the pressure roller 24 is rotary-driven in the arrow R3 direction (counterclockwise) at a predetermined peripheral velocity. The film 23 and the pressure roller 24 constitute a fixing nip portion N, which holds and conveys each recording material P, and fixes the unfixed toner on the recording material P.

The film guide member 21 is a molding made of heat resistant resin, such as PPS (polyphenylene sulfite) or liquid crystal polymer. The heater 22 is a heater made of low heat capacity ceramic. The heater 22 of the present embodiment includes a thin plate type heater substrate 22*a*, which is long sideways and made of alumina or the like, and a linear or narrow strip type electric heating element (resistance heating element) 22*b*,which is made of Ag/Pd or the like, formed in the longitudinal direction on the surface side (film sliding surface side) of the heater substrate 22*a*. The heater 22 also has a thin surface protective layer 22*c*, such as a glass layer, to cover and protect the electric heating element 22*b*. A thermometric element 25, such as a thermistor, is disposed on the rear surface side of the heater substrate 22*a*. This heater 22 is controlled so as to quickly heat up by the power supplied to the electric heating element 22*b*, then maintains a predetermined fixation temperature (target temperature) by a power control system (not illustrated) including the thermometric element 25.

To decrease the heat capacity and make startup quicker, the film 23 as the heating rotating member is a single layer film whose total film thickness is 100 μm or less, preferably 60 μm or less and 20 μm or more, or a composite layer film in which a releasing layer is coated on the surface of the base film. Examples of the materials used for the single layer film are: polytetrafluoroethylene (PTFE), tetrafluoroethylene-perfluoro alkyl vinyl ether (PFA) and PPS, which have, for example, good heat resistance, mold releasability, strength and durability. Examples of materials used for the base film are: polyimide, polyamide imide, polyether ether ketone (PEEK) and polyether sulfone (PES). Examples of materials used for the release layer are: PTFE, PFA and tetrafluoroethylene-perfluoro hexafluoropropylene (FEP).

The pressure roller 24 has a core 24*d* formed of iron, aluminum or the like, and a plurality of elastic layers formed of later mentioned materials using a later mentioned manufacturing method. The surface of the pressure roller 24 is pressed with a predetermined pressing force by a predetermined pressure mechanism (not illustrated) so as to press the surface protective layer 22*c* of the heater 22 via the film 23. According to this pressing force, the elastic layer 24*b* of the pressure roller 24 causes elastic deformation, and a nip portion N having a predetermined width is formed between the surface of the pressure roller 24 and the surface of the film 23.

The film 23 follows the rotation of the pressure roller 24 when the pressure roller 24 is rotary-driven in the arrow R2 direction (counterclockwise) in FIG. 2 at least when an image is formed. In other words, when the pressure roller 24 is rotary-driven, the rotating force is applied to the film 23 in the nip portion N by the friction force between the outer peripheral surface (surface) of the pressure roller 24 and the outer peripheral surface (surface) of the film 23. When the film 23 is rotating, the inner peripheral surface (inner surface) of the film 23 contacts and slides the surface protective layer 22*c* of the heater 22 in the nip portion N. In this case, it is better to provide a lubricant, such as a heat resistant grease, between the inner surface of the film 23 and the surface protective layer 22c of the heater 22 to reduce the sliding resistance.

In the state where the film 23 is rotated by the rotary driving of the pressure roller 24 and the heater 22 is started and controlled to the predetermined fixing temperature, a recording material P bearing a unfixed toner image t is introduced into the nip portion N. The recording material P is held between the surface of the film 23 and the surface of the pressure roller 24 in the nip portion N, and is conveyed in this state. In this conveying process, the heat of the heater 22 is applied to the toner image t via the film 23, and the nip pressure of the nip portion N is also applied to the toner image t. As a result, the toner image t is heated and fixed to the surface of the recording material P. The recording material P that exited from the nip portion N is separated from the surface of the film 23, and is then conveyed and discharged from the fixing apparatus 6.

A heater whose heat capacity is small and whose temperature rises quickly is used in the film heating type fixing apparatus 6 of the present embodiment, and hence the time for the heater 22 to reach a predetermined fixation temperature can be decreased dramatically. Therefore, the fixing apparatus 6 can easily rise to a high fixation temperature even when starting up from room temperature. This means that standby temperature control is unnecessary when printing is not performed and the fixing apparatus 6 is in standby status, and power can be conserved. With substantial tension not being generated in the rotating film 23 except in the nip portion N and the structure of the fixing apparatus 6 being simplified, only a flange member (not illustrated) is disposed to support the edge of the film 23 as a unit to prevent movement of the film from shifting to one side.

Practical Example 1

Figure 3:
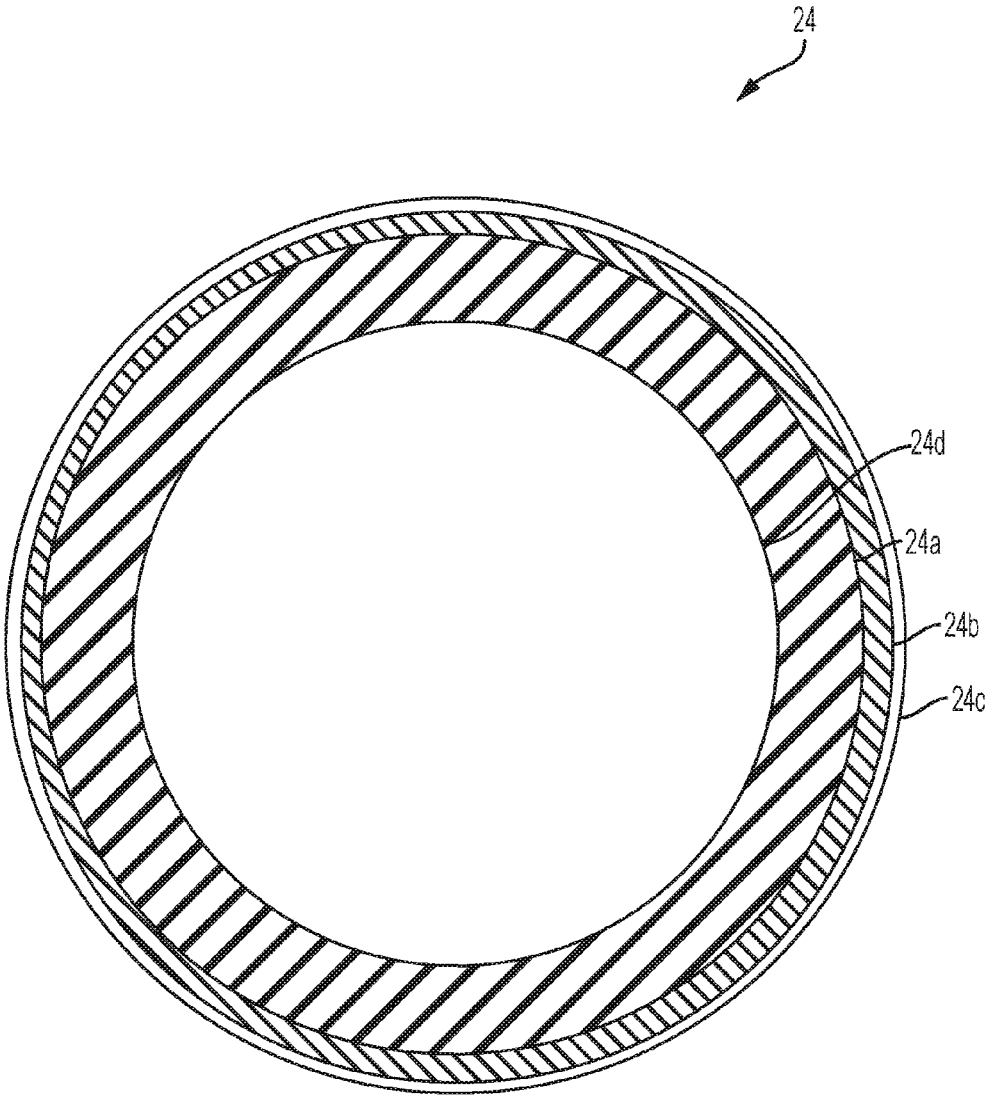
FIG. 3 is a schematic cross-sectional view of a pressure roller of Practical Example 1.
Figure 4:
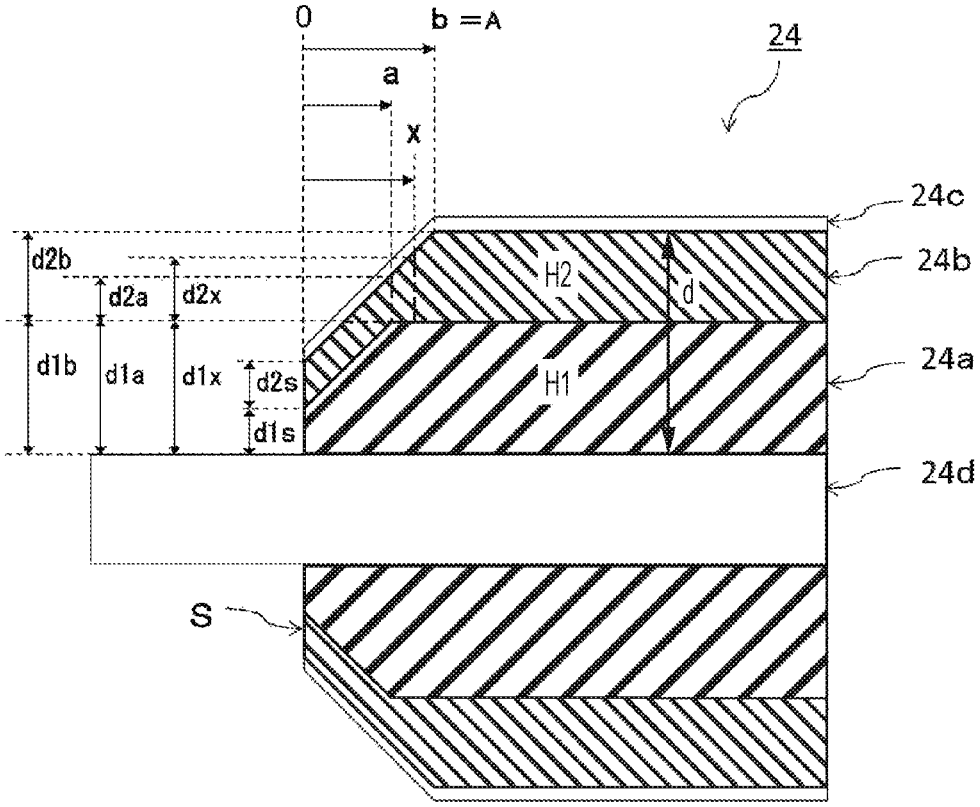
FIG. 4 is a schematic cross-sectional view depicting an area near the edge of the pressure roller of Practical Example 1 in the rotation axis direction.

Details of a pressure roller of Practical Example 1 will be described with reference to FIG. 3 and FIG. 4. FIG. 3 is a cross-sectional view of the pressure roller of Practical Example 1 in the rotation axis direction (axis direction) and shows schematically the structure of layers of this roller. FIG. 4 is a cross-sectional view of the pressure roller of Practical Example 1 in a direction perpendicular to the rotation axis direction of the pressure roller of Practical Example 1, and is a cross-section showing an area around the edge in the rotation axis direction. To simplify the description, the thickness of each elastic layer in FIG. 4 is drawn to be thicker than that of FIG. 3, but the actual thickness of each elastic layer is sufficiently thin with respect to the diameter of the core 24*d*.

<Layer Configuration of Pressure Roller>

The pressure roller 24 of Practical Example 1 includes a core 24*d*, which is a cylindrical shaft, and an elastic layer 24*a*, which is a first elastic layer disposed on or outside the outer periphery of the core 24*d*. The pressure roller 24 also has an elastic layer 24*b*, which is a second elastic layer disposed on (outside) the outer periphery of the elastic layer 24*a*, and the elastic layer 24*b* has a higher thermal conductivity and higher hardness than that of the elastic layer 24*a*. The pressure roller 24 also has a release layer 24*c* on the outer periphery of the thermal conductive elastic layer 24*b*.

In Practical Example 1, the rubber hardness H1 of the rubber material used for the elastic layer 24*a* and the rubber hardness H2 of the rubber material used for the elastic layer 24*b* satisfy the relationship of H1<H2. In concrete terms, in Practical Example 1, the elastic layer 24*a* is a solid rubber layer made of silicon rubber with a 17° JISA hardness, and the elastic layer 24*b* is a rubber layer made of silicon rubber with a 60° JISA hardness, in which a thermo-conductive filler oriented in the longitudinal direction is dispersed. Generally, the rubber hardness tends to increase if the thermo-conductive filler is dispersed.

Here the thickness d of the entire elastic layer used for the pressure roller 24, which is a total of the thickness (width in the diameter direction) d1 of the elastic layer 24*a* and the thickness (width in the diameter direction) d2 of the elastic layer 24*b*, is preferably 2 to 10 mm. In the configuration of Practical Example 1, the thickness d1*b* of the elastic layer 24*a* in the center portion (portion excluding the tapered portion (diameter-reducing portion)) of the pressure roller 24 is 3 mm, the thickness d2*b* of the elastic layer 24*b* is 1 mm, and the thickness d of the entire elastic layer is 4 mm. The hardness of the pressure roller 24 having this configuration, measured by an Ascker-C hardness meter, was 56°.

<Layer Configuration of Edge of Pressure Roller>

In Practical Example 1, the diameters of both edges of the pressure roller 24 are smaller than the diameter of the center portion. In other words, as the cross-section in FIG. 4 shows, the pressure roller 24 has tapered portions (diameter-reducing portions) where the diameter decreases toward the edge in the rotation axis direction when viewed in cross-section. As shown in FIG. 4A, a position where the outer diameter of the entire pressure roller starts to decrease is assumed to be a taper start point A. A position where the outer diameter of the elastic layer 24*a* starts to decrease (a position where the thickness starts to decrease) is assumed to be taper start point (first start point) a, and a position where the outer diameter of the elastic layer 24*b* starts to decrease (position where the thickness starts to decrease) is assumed to be taper start point (second start point) b. The thickness of the elastic layer 24*a* on the end face S is assumed to be d1*s*, and the thickness of the elastic layer 24*b* on the end face S is assumed to be d2*s*.

It is assumed that the position of the end face S of the elastic layer in the rotation axis direction is 0, and the distances from the end face S to the taper start points A, a and b are assumed to be distances A, a and b respectively. In this case, the distances A, a and b have a relationship of a≤b=A. In Practical Example 1, in concrete terms, the distance A of the taper start point A and the distance b of the taper start point b are assumed to be 1.5 mm, and the distance a of the taper start point a is assumed to be 1.0 mm.

In Practical Example 1, it is assumed that the inclination when the outer diameter of the elastic layer 24*a* decreases as it approaches the end face S is approximately the same as the inclination when the outer diameter of the elastic layer 24*b* decreases as it approaches the end face S. The ratio of the thickness d1*a* of the elastic layer 24*a* and the thickness d2*a* of the elastic layer 24*b* at the taper start point a and the ratio of the thickness d1*b* of the elastic layer 24*a* and the thickness d2*b* of the elastic layer 24*b* at the taper start point b satisfy the following relationship: d2*a*/d1*a*≤d2*b*/d1*b*.

It is assumed that the thickness of the elastic layer 24*a* at an arbitrary position x, between the taper start point A to the taper start point a, is d1*x*, and the thickness of the elastic layer 24*b* at the position x is d2*x*. These thicknesses satisfy the relationship of d2*a*/d1*a*≤d2*x*/d1*x*≤d2*b*/d1*b*. In other words, the ratio of the thickness of the elastic layer 24*b* having a higher hardness decreases as a position moves from the taper start point A (taper start position b) to the taper start point a (edge side). Therefore, the hardness of the elastic layer as a whole in an area around the taper start point A decreases, and the elastic layer becomes softer.

<Effect of Practical Example 1>

An effect of using the configuration of Practical Example 1 will be described. As shown in FIG. 4, in Practical Example 1, the ratio of the thickness of the elastic layer 24*b* having a higher hardness to the thickness of the elastic layer 24*a* having a lower hardness decreases as a position approaches the edge from the taper start point A, at which the outer diameter of the pressure roller 24 starts to decrease. In other words, the ratio of the thickness of the elastic layer 24*b* having a higher hardness to the thickness of the elastic layer 24*a* having a lower hardness decreases more in the tapered portion as a position is closer to the edge of the pressure roller 24 in the axis direction, compared with a portion other than the tapered portion.

To satisfy this relationship, Practical Example 1 is configured such that the taper start point a of the elastic layer 24*a* having a low hardness is located closer to the edge in the rotation axis direction (axis direction) than the taper start point b of the elastic layer 24*b* having a higher hardness. In other words, the taper start point b is in a position closer to the center of the pressure roller 24 than the taper start point a. Therefore, the direction from the center to the edge of the pressure roller 24 is the same as the direction from the taper start point b to the taper start point a in the axis direction.

Hence, in the region between the taper start point b and the taper start point a in the axis direction, the outer diameter of the elastic layer 24*b* decreases as a position approaches the edge, but the outer diameter of the elastic layer 24*a* does not change. This means that the ratio of the thickness d2*x*/d1*x* decreases as a position approaches the edge from the taper start point A, as mentioned above. By using this configuration in Practical Example 1, the hardness of the elastic layer as a whole decreases in an area near the taper start point A.

In Practical Example 1, the taper start point a is a position in which the thickness of the elastic layer 24*a* starts to decrease, and is also a position in which the outer diameter of the elastic layer starts to decrease. The taper start point b is a position in which the thickness of the elastic layer 24*b* starts to decrease, and is also a position in which the outer diameter of the elastic layer 24*b* starts to decrease.

Figure 5:
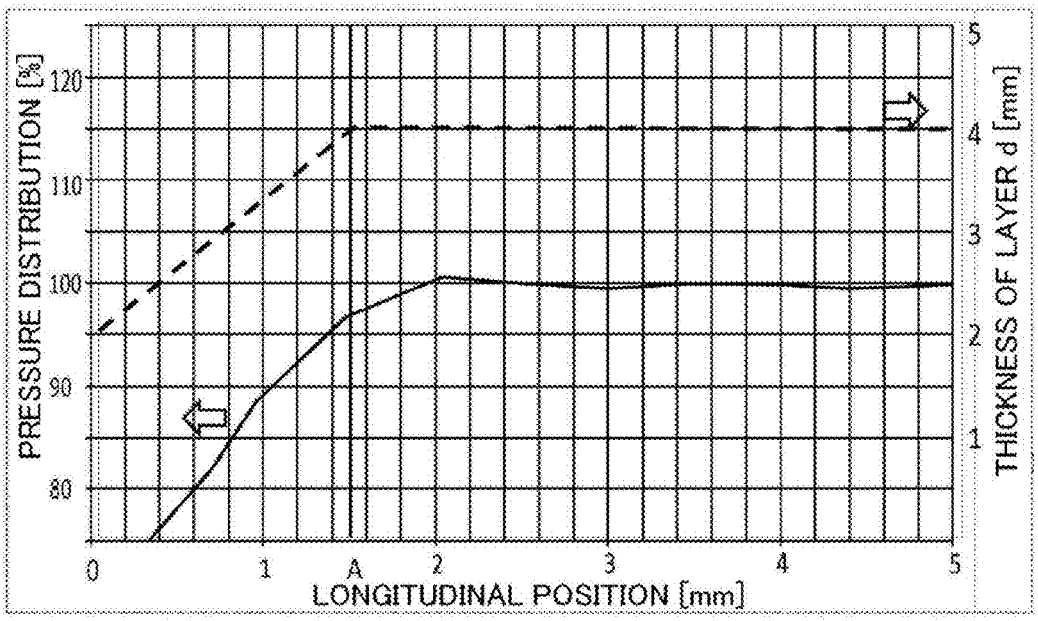
FIG. 5 is a longitudinal hardness distribution diagram of the micro-hardness in the pressure roller of Practical Example 1.
Figure 7A:
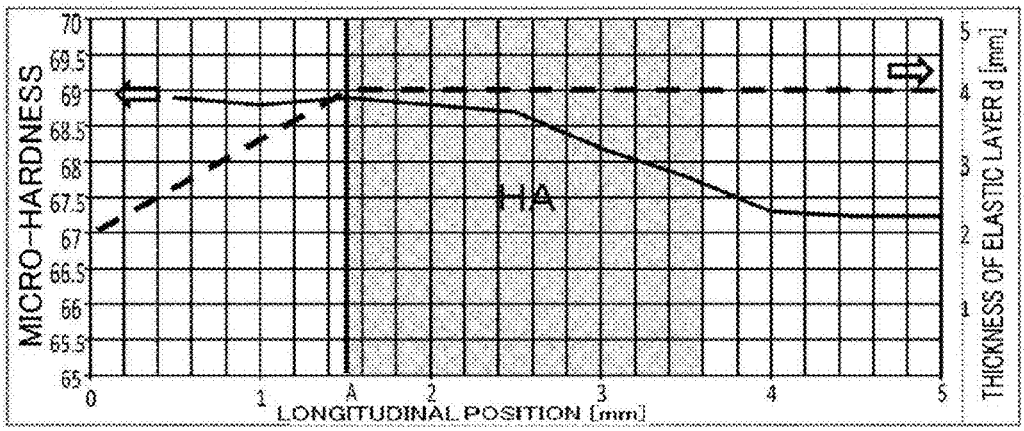
FIG. 7A and FIG. 7B are longitudinal hardness distribution diagrams of micro-hardness in a pressure roller of a prior art.
Figure 7B:
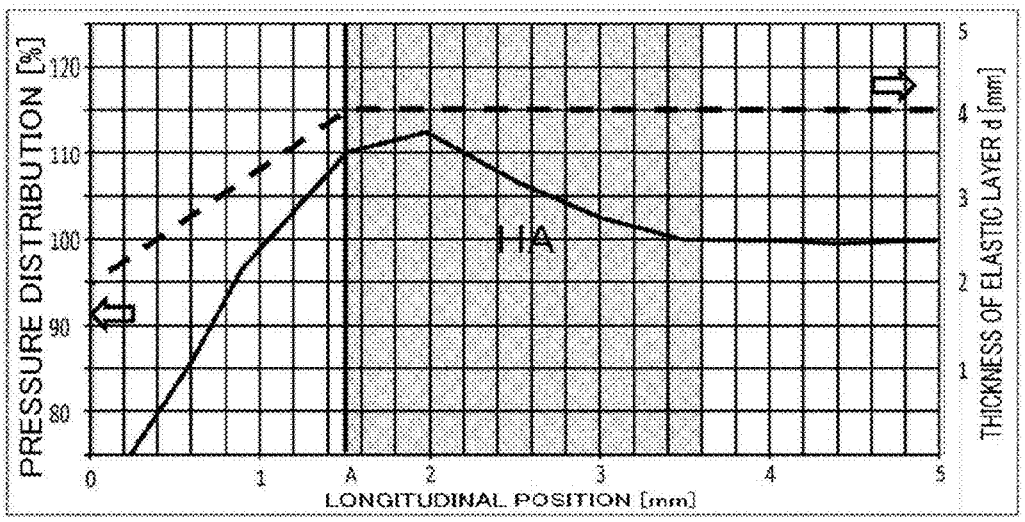

FIG. 5 is a longitudinal hardness distribution diagram of micro-hardness in the pressure roller of Practical Example 1. As FIG. 5 shows, an abnormal hardness region HA, where the hardness increases as a position approaches the tapered portion, as shown in FIG. 7A and FIG. 7B, is not generated in the pressure roller of Practical Example 1. Therefore, the surface layer abrasion of the film can be suppressed if the configuration of Practical Example 1 is used.

In this practical example, the elastic layer 24*b* is a rubber layer where thermo-conductive filler is dispersed, and the elastic layer 24*a* is a solid rubber layer, but the present invention is not limited to this. In other words, the effect of this example is demonstrated if the rubber hardness of the elastic layer 24*b* is higher than the hardness of the rubber of the elastic layer 24*a*. For example, the elastic layer 24*b* may be a solid rubber layer, and the elastic layer 24*a* may be a sponge rubber layer.

In this practical example, the fixing apparatus which includes the film as the heating rotating member is used, but the present invention is not limited to this configuration. For example, the fixing apparatus may include a heat roller as the heating rotating member.

Practical Example 2

Figure 6:
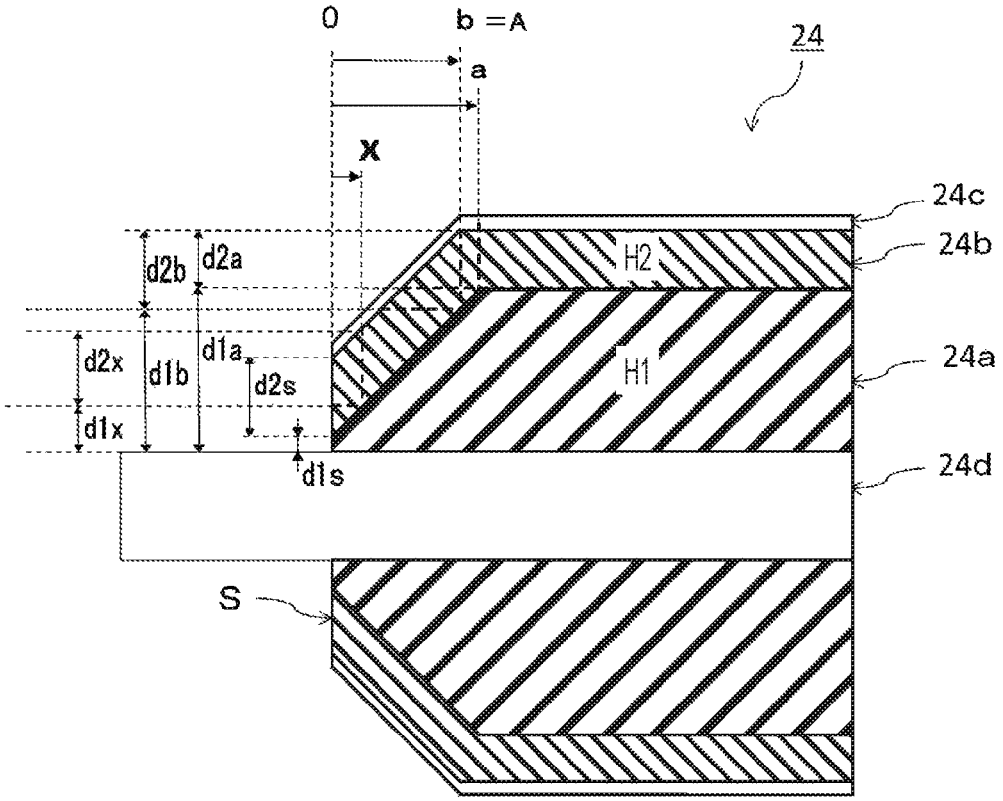
FIG. 6 is a schematic cross-sectional view depicting an area near the edge of the pressure roller of Practical Example 2 in the rotation axis direction.

Next, Practical Example 2 will be described with reference to FIG. 6. FIG. 6 is a cross-sectional view in a direction perpendicular to the rotation axis direction of the pressure roller of Practical Example 2, and is a cross-section shown an area around the edge in the rotation axis direction. In Practical Example 2, the relationship of the rubber hardness H1 of the elastic layer 24*a* (first elastic layer) and the rubber hardness H2 of the elastic layer 24*b* (second elastic layer) is H1>H2. In other words, in Practical Example 2, the elastic layer 24*a* is a rubber layer in which a thermo-conductive filler is disposed, and the elastic layer 24*b* is a solid rubber layer.

In Practical Example 2, when the distances from the end face S to the taper start point A of the pressure roller 24, the taper start point a of the elastic layer 24*a*, and the taper start point b of the elastic layer 24*b* are A, a and b, the relationship of A, a and b is A=b<a.

As shown in FIG. 6, in Practical Example 2, the ratio of the thickness of the elastic layer 24*a* having a higher hardness to the thickness of the elastic layer 24*b* having a lower hardness decreases as a position approaches the edge from the taper start point A, at which the outer diameter of the pressure roller 24 starts to decrease. In other words, d1*x*/d2*x* decreases as a position is closer to the edge from the taper start point A located near a largest diameter part of the tapered portion.

To satisfy this relationship, Practical Example 2 is configured such that the tapered start point b of the elastic layer 24*b* having a lower hardness is located closer to the edge in the rotation axis direction than the taper start point a of the elastic layer 24*a* having a higher hardness.

In other words, in the axial direction of the pressure roller 24 the taper start point a is in a position closer to the center of the pressure roller 24 than the taper start point b. Therefore, the direction from the center to the edge of the pressure roller 24 is the same as the direction from the taper start point a to the taper start point b in the axis direction.

This means that the elastic layer 24*a* gradually becomes thinner as a position approaches the edge of the pressure roller 24 in the axis direction from the taper start point b, although the thickness of the elastic layer 24*b* is the same. As a result, the hardness of the elastic layer as a whole decreases as a position approaches the edge from the taper start point A.

Further, as shown in FIG. 6, the thickness of the elastic layer 24*a* decreases and the thickness of the elastic layer 24*b* increases between the taper start point a and the taper start point b (taper start point A) as a position approaches the edge. Therefore, the hardness of the elastic layer as a whole becomes higher as a position approaches from the taper start point a to the taper start point A.

By using this configuration in Practical Example 2, an abnormal increase of the hardness of the pressure roller near the tapered portion can be suppressed, just like Practical Example 1. As a result, the surface layer abrasion of the heating rotating member, such as the film and the heat roller, can be suppressed.

In Practical Example 2 as well, the effect of this example can be demonstrated if the rubber hardness of the elastic layer 24*a* is higher than the rubber hardness of the elastic layer 24*b*. Therefore, the elastic layer 24*a* may be a solid rubber layer, and the elastic layer 24*b* may be a sponge rubber layer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-214833, filed Oct. 21, 2014, which is hereby incorporated by reference herein in its entirety.

What is claimed is:

1. A roller used for a fixing apparatus, comprising:

a core;

a first elastic layer that is formed outside the core and includes a first tapered portion on an edge of the first elastic layer in an axis direction; and a second elastic layer that is formed outside the first elastic layer and includes a second tapered portion on an edge of the second elastic layer in the axis direction on the same side as the first elastic layer, the second elastic layer having hardness that is higher than hardness of the first elastic layer, wherein a second start point, which is a start point of the second tapered portion, is set in a position closer to the center of the roller in the axis direction than a first start point which is a start point of the first tapered portion.

2. The roller according to claim 1, wherein in a region from the second start point to the first start point in the axis direction, the ratio of the thickness of the second elastic layer to the thickness of the first elastic layer decreases as a position approaches from the second start point to the first start point.

3. The roller according to claim 1, wherein the second elastic layer is a rubber layer in which a thermo-conductive filler is dispersed.

4. The roller according to claim 1, wherein the first elastic layer is a solid rubber layer.

5. A roller used for a fixing apparatus, comprising:

a core; and an elastic layer that is formed outside the core, the elastic layer including a first elastic layer and a second elastic layer formed outside the first elastic layer and having a hardness that is higher than the hardness of the first elastic layer, wherein a tapered portion is formed on an edge of the elastic layer in an axis direction, and wherein the tapered portion has a region where the ratio of the thickness of the second elastic layer to the thickness of the first elastic layer decreases as a position approaches an end of the roller in the axis direction on the side where the tapered portion is formed.

6. A roller used for a fixing apparatus, comprising:

a core;

a first elastic layer that is formed outside the core and includes a first tapered portion on an edge of the first elastic layer in an axis direction; and a second elastic layer that is formed outside the first elastic layer and includes a second tapered portion on an edge of the second elastic layer in the axis direction on the same side as the first elastic layer, the second elastic layer having a hardness that is lower than the hardness of the first elastic layer, wherein a first start point, which is a start point of the first tapered portion, is set in a position closer to the center of the roller in the axis direction than a second start point, which is a start point of the second tapered portion.

7. The roller according to claim 6, wherein in a region from the first start point to the second start point in the axis direction, the ratio of the thickness of the second elastic layer to the thickness of the first elastic layer increases as a position approaches from the first start point to the second start point.

8. The roller according to claim 6, wherein the first elastic layer is a rubber layer in which a thermo-conductive filler is dispersed.

9. The roller according to claim 6, wherein the second elastic layer is a solid rubber layer.

10. A roller used for a fixing apparatus, comprising:

a core; and an elastic layer that is formed outside the core, the elastic layer including a first elastic layer and a second elastic layer formed outside the first elastic layer and having a hardness that is lower than the hardness of the first elastic layer, wherein a tapered portion is formed on an edge of the elastic layer in the axis direction, and wherein the tapered portion has a region where the ratio of the thickness of the second elastic layer to the thickness of the first elastic layer increases as a position approaches the end of the roller in the axis direction on the side where the tapered portion is formed.

11. A fixing apparatus that conveys and heats a recording material bearing a toner image at a nip portion, comprising:

a heating rotating member; and a roller that contacts the heating rotating member and forms the nip portion, the roller including a core, a first elastic layer that is formed outside the core, and a second elastic layer formed outside the first elastic layer and having a hardness that is higher than the hardness of the first elastic layer, wherein a first tapered portion is formed on an edge of the first elastic layer in an axis direction of the roller, and a second tapered portion is formed on an edge of the second elastic layer in the axis direction, and wherein a second start point, which is a start point of the second tapered portion, is set in a position closer to the center of the roller in the axis than a first start point which is a start point of the first tapered portion.

12. The fixing apparatus according to claim 11, wherein the heating rotating member is a film.

13. A fixing apparatus that conveys and heats a recording material bearing a toner image at a nip portion, comprising:

a heating rotating member; and a roller that contacts the heating rotating member and forms the nip portion, the roller including a core, a first elastic layer formed outside the core, and a second elastic layer formed outside the first elastic layer and having a hardness that is lower than the hardness of the first elastic layer, wherein a first tapered portion is formed on an edge of the first elastic layer in the axis direction of the roller, and a second tapered portion is formed on an edge of the second elastic layer in the axis direction, and wherein a first start point, which is a start point of the first tapered portion, is set in a position closer to the center of the roller than a second start point, which is a start point of the second tapered portion.

14. The fixing apparatus according to claim 13, wherein the heating rotating member is a film.

* * * * *